US005864203A

United States Patent [19]

Yamane

[11] Patent Number: 5,864,203

[45] **Date of Patent: *Jan. 26, 1999**

[54] DYNAMIC FOCUSING ELECTRON GUN

[75] Inventor: Hisakazu Yamane, Nagaokakyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 698,767

[22] Filed: Aug. 16, 1996

Related U.S. Application Data

[63] Continuation of Ser. No. 372,581, Jan. 13, 1995, abandoned.

[30] Foreign Application Priority Data

Mar. 25, 1994 [JP] Japan ..... 6-055689

[51] Int. Cl.[6] ..... H01J 29/56

[52] U.S. Cl. ..... 313/414; 313/449; 315/15; 315/382

[58] Field of Search ..... 313/412, 414, 313/300, 449, 452, 453; 315/15, 382

[56] References Cited

U.S. PATENT DOCUMENTS

| | | | |
|---|---|---|---|
| 4,086,513 | 4/1978 | Evans, Jr. | 313/414 |
| 4,825,120 | 4/1989 | Takahashi | 313/414 |
| 4,886,999 | 12/1989 | Yamane et al. | 313/414 |
| 5,061,881 | 10/1991 | Suzuki et al. . | |
| 5,384,512 | 1/1995 | Kamohara et al. | 313/414 |
| 5,404,071 | 4/1995 | Son | 313/414 |

FOREIGN PATENT DOCUMENTS

| | | | |
|---|---|---|---|
| 395835 | 4/1991 | Japan . | |
| 393135 | 5/1991 | Japan . | |
| 5166468 | 7/1993 | Japan | H01J 29/50 |
| 5225929 | 9/1993 | Japan | H01J 29/50 |
| 901502 | 3/1990 | Rep. of Korea | H01J 29/50 |
| 925235 | 7/1992 | Rep. of Korea | H01J 29/50 |

*Primary Examiner*—Sandra O'Shea
*Assistant Examiner*—Michael Day

[57] ABSTRACT

An electron gun of a multi-stage convergence type includes a plurality of focusing electrodes, wherein a quadrupole lens nearest to a cathode has a diverging function in the horizontal scanning direction and a converging function in the vertical scanning direction, and a quadrupole lens in the next stage has a converging function in the horizontal scanning direction and a diverging function in the vertical scanning direction. In this structure, even when a voltage synchronized with a deflection current is superposed on a constant focus voltage, applied to the focusing electrode, the operation of the quadrupole lenses is not influenced significantly.

2 Claims, 18 Drawing Sheets

DYNAMIC FOCUSING ELECTRON GUN

This application is a continuation of application Ser. No. 08/372,581 filed on Jan. 13, 1995, now abandoned.

BACKGROUND OF THE INVENTION

1. Field of the Invention

The present invention relates to a cathode-ray tube in which electron beams emitted from an electron gun are deflected to project an image on a fluorescent screen and also relates to an electron gun used in the cathode-ray tube.

2. Description of the Related Art

FIG. 1 is a schematic cross sectional view showing a conventional color cathode-ray tube provided with an electron gun. In the figure, reference numeral 31 indicates a glass enclosure which has an ordinary cathode-ray tube shape and includes a neck 32, a funnel 33 and a face 34. An electron gun 24 is arranged at the neck 32 of the glass enclosure 31. Fluorescent materials for red, green and blue are applied in a mosaic fashion to an inner surface of a face plate 27 of the face 34 to form a fluorescent layer 26. An inner duck 23 for allowing conduction of a high voltage is formed at an inner surface of the funnel 33. A deflection yoke 22 is arranged around a junction between the funnel 33 and the neck 32 so as to deflect the electron beams emitted from the electron gun 24.

The electron gun 24 includes a cathode 1 for emitting electrons, a control electrode 2 for controlling a path of the electron beams emitted from the cathode 1, an accelerating electrode 3 for accelerating the electron beams, a focusing electrode 35 for focusing the electron beams, and a final accelerating electrode 8 for finally accelerating the electron beams. The final accelerating electrode 8 is conductively welded to a shield cup 36, and is applied with a high voltage from an anode button via the inner duck 23 and the shield cup 36. Predetermined voltages are applied to the other electrodes (i.e., control electrode 2, accelerating electrode 3 and focusing electrode 35) via pins 37 arranged at an end of the neck 32. The cathode 1 is formed of a cathode 1*a* for a red beam, a cathode 1*b* for a green beam and a cathode 1*c* for a blue beam.

According to the cathode-ray tube thus constructed, the electron beams emitted from the electron gun 24 are deflected by the deflection yoke 22 and impinged on the fluorescent layer 26 to form a visible image.

The resolution characteristics of the cathode-ray tube depend significantly on a diameter and a shape of a spot of the electron beams impinging on the fluorescent layer 26. More specifically, as the spot diameter decreases and/or the spot roundness increases, the resolution is improved. The small diameter and high roundaness of the spot are required of the screen of the fluorescent layer 26 on which the image is formed.

However, the screen surface (fluorescent layer 26 and face plate 27) of the cathode-ray tube is generally flat, so that, to a higher extent the electron beam is deflected toward a periphery of the screen, a longer distance the electric beam travels. Therefore, when the focus voltage provided to the focusing electrode 35 is controlled to reduce the spot diameter of the electron beams at a central portion of the screen and to increase the roundness of the same, the electron beams at the peripheral portion of the screen are over-focused and thus cannot form the electron beam spot of a small diameter. This results in reduction of the resolution.

In view of the above, a so-called dynamic focus system has been proposed. In this system, the focus voltage applied to the focusing electrode 35 is increased to -weaken the focusing function of the main electron lens formed of the focusing electrode 35 in accordance with an increase in the degree of deflection of the electron beams. However, this system is not suitable to a self-convergence system used in an in-line type electron gun which has generally been used in recent years, for the following reasons. The inline type electron gun emitting three electron beams along a horizontal straight line, employs the self-convergence system in which the horizontal deflection magnetic field is distorted in a pin-cushion-like form, and a vertical deflection magnetic field is irregularly distorted in a barrel-like form. The electron beams passing therethrough are forced to diverge horizontally and to converge vertically, so that they form a horizontally long flat form.

Accordingly, the electron beams deflected toward the periphery of the screen have a horizontal spot diameter maintained at the optimum focus state, but they have a vertical spot diameter in the over-focus state, resulting in generation of a low luminance portion, i.e., so-called "halo". In connection with this state, when the dynamic focus system is employed, the vertical spot diameter in the over-focus state is corrected, so that generation of the low luminance portion, i.e., halo, is avoided and the optimum focus state is attained. Meanwhile, the horizontal spot diameter is out of the optimum focus state and is in the under-focus state. Thereby, the horizontal spot diameter increases, and the horizontal resolution is remarkably impaired. Accordingly, the resolution at the periphery of the screen is not improved.

FIG. 2 is an enlarged cross sectional view of the conventional electron gun 24 for overcoming the above problems, which is disclosed in Japanese Patent Application Laid-Open No. 3-93135 (1991). This electron gun 24 includes the cathodes 1*a*, 1*b* and 1*c*, control electrode 2, accelerating electrode 3, first auxiliary electrode 4, second auxiliary electrode 5, first focusing electrode 6, second focusing electrode 7 and final accelerating electrode 8 which are disposed in this order. This conventional electron gun has been called an electron gun of a bipotential type. Structures other than the above are same as those shown in FIG. 1.

FIG. 3 is a front view of the first auxiliary electrode 4. The first auxiliary electrode 4 has a plate-like form, and is provided at positions corresponding to the cathodes 1*a*, 1*b* and 1*c* with circular apertures 4*a*, 4*b* and 4*c*. On a surface of the first auxiliary electrode 4 near to the screen, there are provided paired plates 4*d*, 4*e* and 4*f* which are located at vertically opposite sides of the apertures 4*a*, 4*b* and 4*c*, respectively, and each has a predetermined thickness and is slightly larger than the diameter of the apertures 4*a*, 4*b* and 4*c*.

FIG. 4 is a rear view from the side of the cathodes 1*a*, 1*b* and 1*c* of the second auxiliary electrode 5. The second auxiliary electrode 5 has a plate-like form, and has circular apertures 5*a*, 5*b* and 5*c* located at positions corresponding to the cathodes 1*a*, 1*b* and 1*c*. On the side of the cathodes 1*a*, 1*b* and 1*c* of the second auxiliary electrode 5, there are provided paired plates 5*d*, 5*e* and 5*f*, which are located at laterally opposite sides of the apertures 5*a*, 5*b* and 5*c*, respectively, and each has a predetermined thickness and is slightly larger than the diameter of the apertures 5*a*, 5*b* and 5*c*. Likewise, on the screen side of the second auxiliary electrode 5 plates 5*g*, 5*h* and 5*i* are set up.

FIG. 5 is a rear view from the side of the cathodes 1*a*, 1*b* and 1*c* of the first focusing electrode 6. The first focusing electrode 6 has a box-like form. On the surface of the cathodes 1*a*, 1*b* and 1*c* side of the first focusing electrode 6, there are formed circular apertures 6*a*, 6*b* and 6*c* located at positions corresponding to the cathodes 1*a*, 1*b* and 1*c*, respectively. On the same surface, paired plates 6*d*, 6*e* and 6*f* are set up, which are located at vertically opposite sides of the apertures 6*a*, 6*b* and 6*c*, respectively, and each has a predetermined thickness and is slightly larger than the diameter of the apertures 6*a*, 6*b* and 6*c*.

FIG. 6 is a front view from the side of the screen of the first focusing electrode 6. On the surface of the screen side of the first focusing electrode, there are formed square apertures 6*g*, 6*h* and 6*i* each having a width slightly larger than the diameter of the apertures 6*a*, 6*b* and 6*c* and a vertical length larger than the width.

FIG. 7 is a rear view from the side of the cathodes 1*a*, 1*b* and 1*c* of the second focusing electrode 7. The second focusing electrode 7 has a box-like form. On the surface of the cathodes 1*a*, 1*b* and 1*c* side of the second focusing electrode 7, there are formed square apertures 7*a*, 7*b* and 7*c* each having a vertical length slightly larger than the diameter of the apertures 6*a*, 6*b* and 6*c* and a lateral width larger than the vertical length.

The first auxiliary electrode 4 and first focusing electrode 6 are maintained at the same potential by a connector, and are applied with a constant focus voltage $V_F$. The second auxiliary electrode 5 and second focusing electrode 7 are maintained at the same potential by a connector, and are applied with the constant focus voltage $V_F$. Further, the second auxiliary electrode 5 and second focusing electrode 7 are supplied in a superposed manner with a voltage, which increases in synchronization with a deflecting current as the degree of deflection of the electron beams increases, from a circuit 9.

Operation of the electron gun 24 thus constructed will be described below.

FIGS. 8 and 9 are cross sectional views showing the electron beams and optical operation of electron lenses in the case where the electron beams are deflected toward a periphery of the screen. More specifically, FIG. 8 shows a horizontal section of the electron beams, and FIG. 9 shows a vertical section thereof. In these figures, reference numeral 10 indicates a cross-over position of the electron beams corresponding to an object point. In the figures, numeral 11 shows a path of the electron beams at the most external angle.

A description will now be given in connection with the horizontal direction. The electron beams emitted at a divergence angle θ from the object point 10 impinge at an incident angle $\theta_H$ fron the screen (fluorescent layer) 26 after passing through a concave lens 12 which is a horizontal operation of a first quadrupole lens formed of the first auxiliary electrode 4, second auxiliary electrode 5 and first focusing electrode 6, a convex lens 13 which is a horizontal operation of a second quadrupole lens formed of the first focusing electrode 6 and second focusing electrode 7, a convex lens 14 which is a main electron lens formed of the second focusing electrode 7 and final accelerating electrode 8, and a concave lens 15 which is formed by a magnetic field (horizontal component) of the deflection yoke 22.

A description will now be given in connection with the vertical direction. The electron beams emitted at a divergence angle θ from the object point 10 impinge at an incident angle $\theta_V$ on the screen (fluorescent layer) 26 after passing through a convex lens 16 which is a vertical operation of the first quadrupole lens formed of the first auxiliary electrode 4, second auxiliary electrode 5 and first focusing electrode 6, the concave lens 17 which is a vertical operation of the second quadrupole lens formed of the first focusing electrode 6 and second focusing electrode 7, the convex lens 14 which is the main electron lens formed, of the second focusing electrode 7 and final accelerating electrode 8, and the convex lens 18 which is formed by a vertical component of the magnetic field formed by a magnetic field (vertical component) of the deflection yoke 22.

The irregular magnetic field produced by the deflection yoke 22 is corrected by the first quadrupole lens (12 and 16), second quadrupole lens (13 and 17) and main electron lens 14, so that the optimum focus state of the electron beams is attained in both the horizontal and vertical directions at the peripheral portion of the screen. Owing to the operation of the first quadrupole lens (12 and 16), the electron beams can form the substantially equal incident angles $\theta_V$ and $\theta_V$ in the horizontal and vertical directions with respect to the screen. As a result, the roundness of the spot shape of the electron beams is improved.

The electron gun of the bipotential type described above has a simple structure, but is not provided with a lens for preliminary convergence, so that the electron beam incident on the main electron lens has a large diameter. Since the diameter of electron beam incident on the main electron lens is proportional to an amount (current) of the electron beam, the electron beam which scans a peripheral region having an increased luminance (i.e., high luminance region) has a large diameter. When the electron beam has a large diameter as described above, the focus is impaired due to the influence by the spherical aberration of the main electron lens.

The above problems may be overcome by an electron gun of a multi-stage convergence type, in which a first subsidiary lens 20 and a second subsidiary lens 21 are disposed between the accelerating electrode 3 and the first auxiliary electrode 4 for preliminarily converging the electron beams as shown in FIG. 10. However, this extremely complicates the structure.

SUMMARY OF THE INVENTION

The present invention has been developed to overcome the above-noted problems, and it is a main object of the invention to provide a cathode-ray tube and an electron gun provided in a cathode-ray tube, in which a subsidiary lens and quadrupole lenses at multiple stages are provided to form a structure of a multi-stage convergence type, so that an image of a high resolution can be formed throughout a screen.

In a cathode-ray tube and an electron gun according to the present invention, lens operations of the quadrupole lenses at the multiple stages are different in the horizontal scanning direction and the vertical scanning direction. Therefore, magnifications (diverging angles) of the electron beams in the horizontal scanning direction and vertical scanning direction can be individually corrected.

In the cathode-ray tube and the electron gun according to the invention, the quadrupole lens nearest to a cathode side among the quadrupole lenses at the multiple stages has a diverging function in the horizontal scanning direction and a converging function in the vertical scanning direction. The quadrupole lens at the next stage has a converging function in the horizontal direction and a diverging function in the vertical scanning direction. Therefore, the configuration of the electron beams can be corrected in such a manner that the over-focus in the vertical scanning direction, which is caused by the self-convergence system described above, can be avoided.

In the cathode-ray tube and an electron gun according to the present invention, the quadrupole lenses of the multiple stages described above has such a configuration that a third focusing electrode is provided in the upstream stage (cathode side) of the first focusing electrode and a second focusing electrode which conventionally have been provided. Each of these electrodes has a circular electron beam passing aperture, and may have a structure selected from the following. That is, on the surface of the first focusing electrode side of the third focusing electrode, plates are set up on the horizontally opposite sides of the electron beam passing aperture, and on the surface of the third focusing electrode side of the first focusing electrode, plates are set up on the vertically opposite sides of the circular electron beam passing aperture. On the surface of the first focusing electrode side of the third focusing electrode, a noncircular electron beam passing aperture being long in the vertical scanning direction is provided, and on the surface of the third focusing electrode side of the first focusing electrode, a noncircular electron beam passing aperture being long in the horizontal scanning direction is provided. Owing to these structures, the quadrupole lens nearest to the cathode side can have the diverging function in the horizontal scanning direction and the converging function in the vertical scanning direction. Further, the quadrupole lens in the next stage can have the converging function in the horizontal scanning direction and the diverging function in the vertical scanning direction.

In any of the structures described above, a constant focus voltage is applied to the first focusing electrode, and a voltage formed of a constant focus voltage and a voltage superposed thereon is applied to the second and third focusing electrodes, the voltage superposed on the constant focus voltage being synchronized with a deflection current and increasing in accordance with the increase of the degree of deflection. Therefore, the cross-over position of the electron beams and the electric field produced by an accelerating electrode are not adjacent to each other. Therefore, even when the voltage synchronized with the deflection current is superposed on the focusing electrode, the operation of quadrupole lenses is not affected thereby. Moreover, a diameter of an electron beam spot at a peripheral portion of the screen can be reduced.

The above and further objects and features of the invention will more fully be apparent from the following detailed description with accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Embodiments of the present invention will be described below with reference to the drawings.

Embodiment 1

Figure 11:
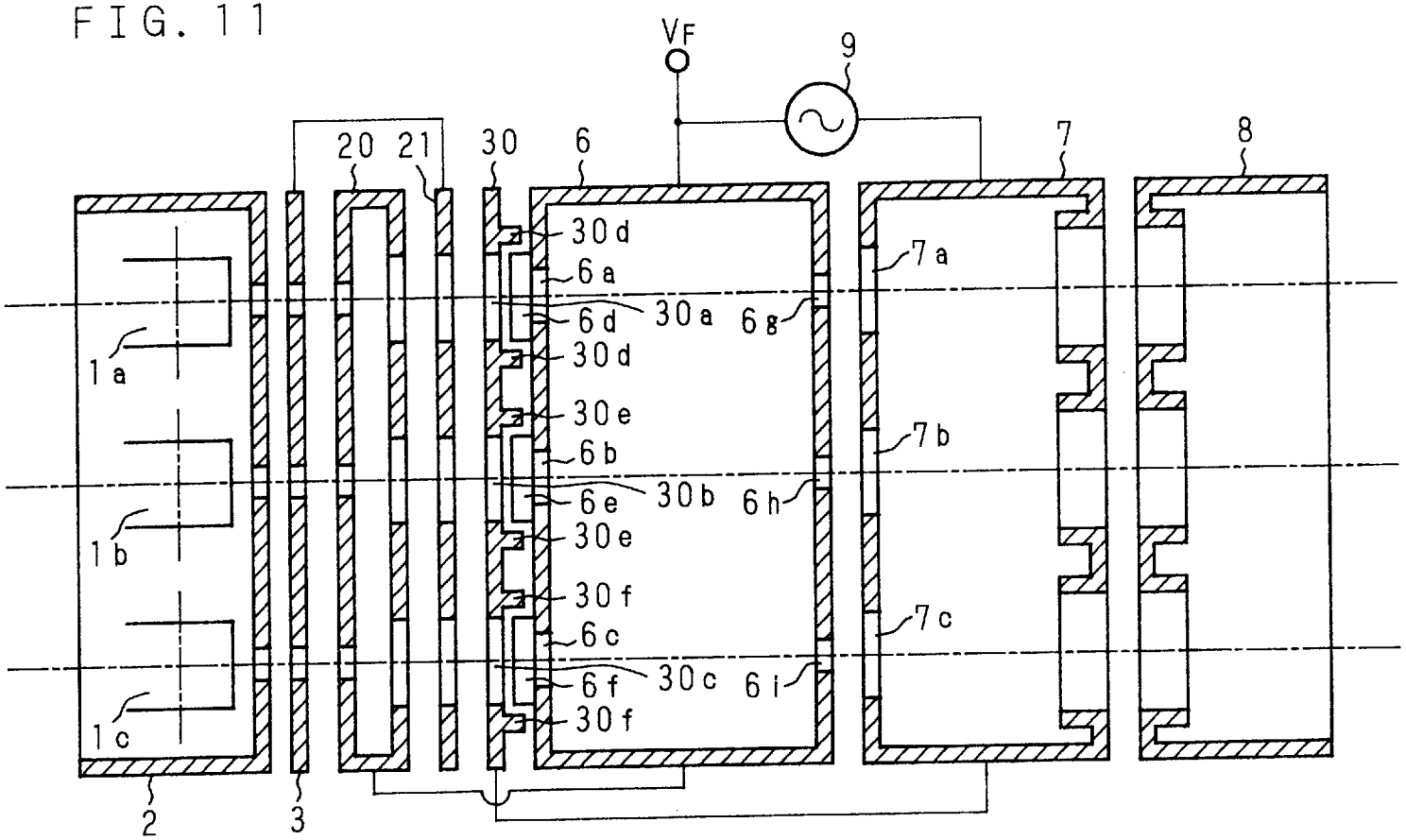
FIG. 11 is a cross sectional view showing an electron gun according to the invention.

FIG. 11 is a cross sectional view showing an electron gun according to the present invention, which is a color cathode-ray tube. The electron gun has a structure of a multi-stage convergence type, and includes cathodes 1*a*, 1*b* and 1*c* for emitting electron beams of red, green and blue, respectively, a control electrode 2 for controlling paths of the electron beams emitted from the cathodes 1*a*, 1*b* and 1*c*, an accelerating electrode 3 for accelerating the electron beams, a first subsidiary lens electrode 20, a second subsidiary lens electrode 21, a third focusing electrode 30, a first focusing electrode 6, a second focusing electrode 7 and a final accelerating electrode 8 disposed in this order. The accelerating electrode 3 and the second subsidiary lens 21 are applied with the same voltage, and the first subsidiary lens electrode 20 and the first focusing electrode 6 are applied with a constant focus voltage $V_F$. The second focusing electrode 7 and the third focusing electrode 30 are applied with a constant focus voltage $V_F$, on which a circuit 9 superposes a voltage synchronized with a deflection current and increasing in accordance with the degree of deflection of the electron beams.

The first subsidiary lens electrode 20 has a flat box-like form similarly to the conventional one, and is provided with apertures which are formed at its surface on the screen side (the second subsidiary lens electrode 21 side) and are larger than apertures formed at its surface on the cathodes 1*a*, 1*b* and 1*c*. The second subsidiary lens electrode 21 has a plate-like form, and is provided with apertures of sizes similar to those of the apertures formed at the surface of the screen side of the first subsidiary lens electrode 20.

Figure 10:
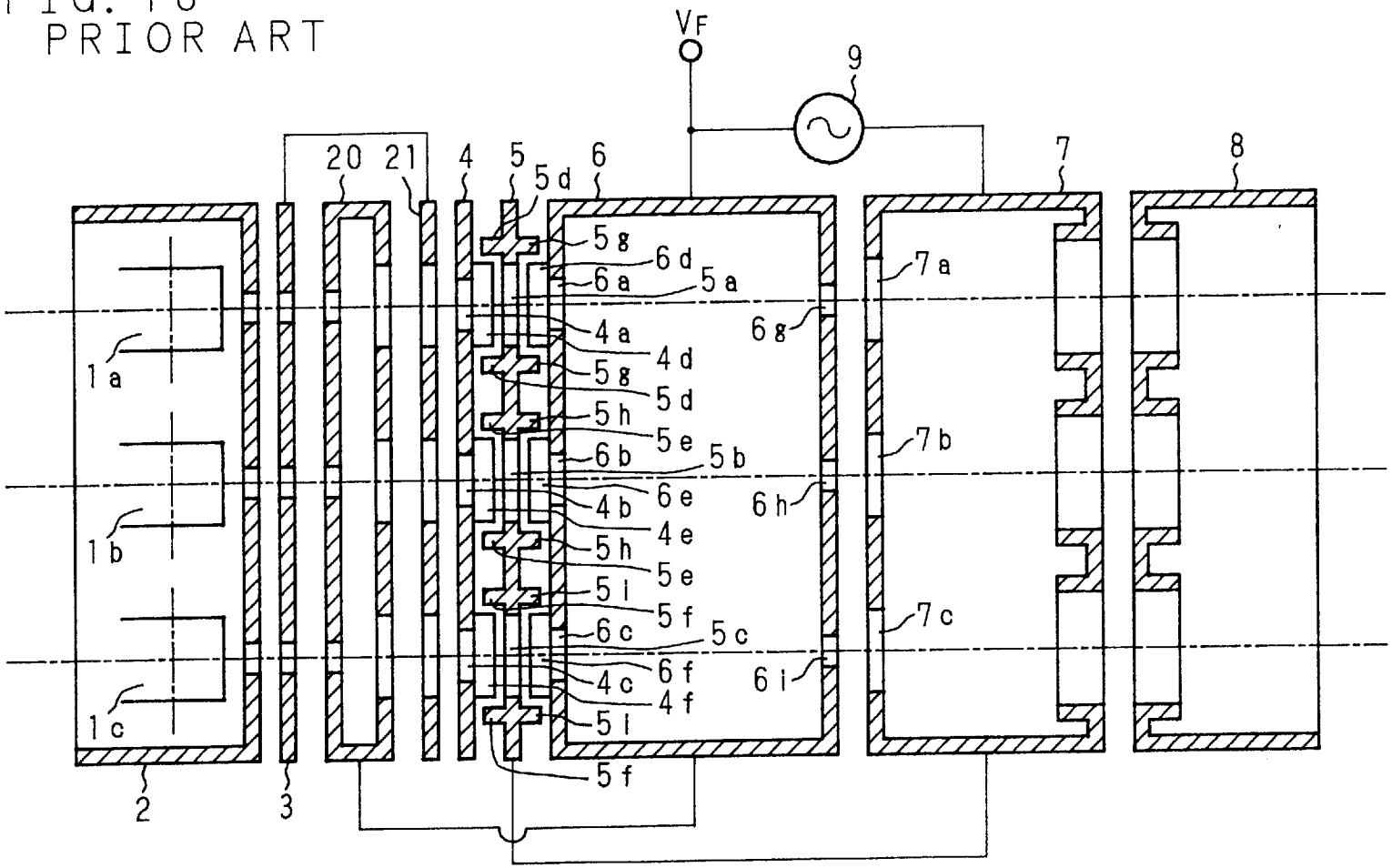
FIG. 10 PRIOR ART
FIG. 10 is a schematic cross sectional view showing a structure of a conventional electron gun of a multi-stage convergence type.
Figure 12:
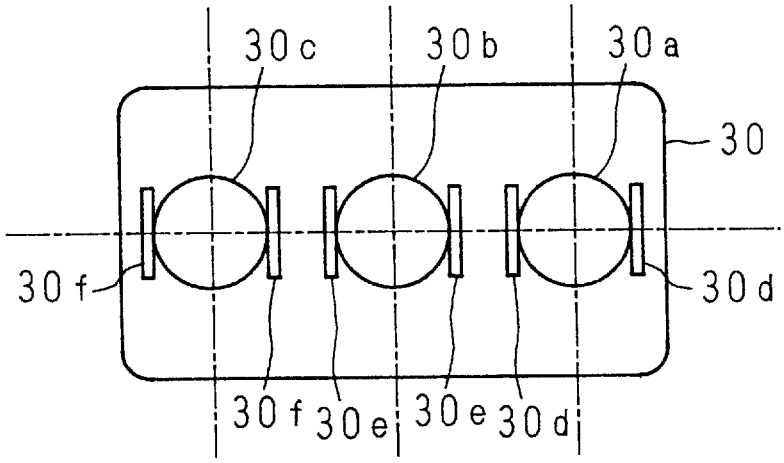
FIG. 12 is a front view showing a final accelerating electrode side (screen side) of a third focusing electrode.

FIG. 12 is a front view showing the final accelerating electrode 8 side (on the screen side) of the third focusing electrode 30 which is employed instead of the first and second auxiliary electrodes 4 and 5 in the prior art shown in FIG. 10. The third focusing electrode 30 has a plate-like form, and is provided with circular apertures 30*a*, 30*b* and 30*c* which are located at positions corresponding to the cathodes 1*a*, 1*b* and 1*c* and have sizes similar to those of the apertures at the second subsidiary lens electrode 21. On the front surface of the third focusing electrode 30, there are set up plates 30*d*, 30*e* and 30*f* which are located at laterally opposite sides of the apertures 30*a*, 30*b* and 30*c* and have a space therebetween slightly larger than the diameter of the apertures 30*a*, 30*b* and 30*c*, respectively.

Figure 13:
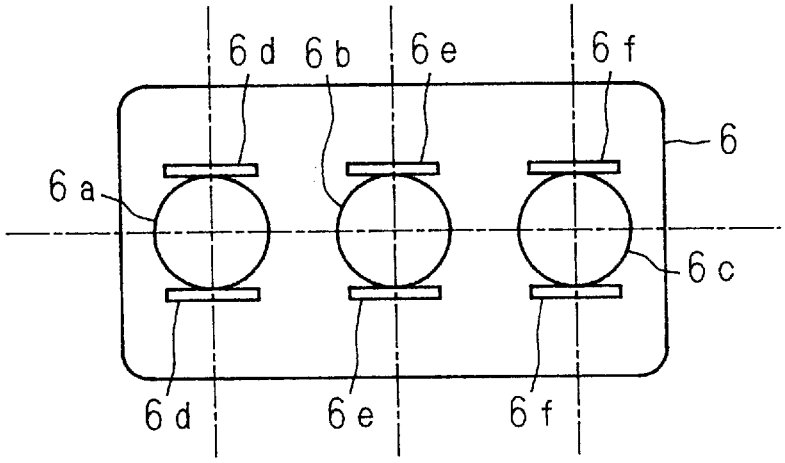
FIG. 13 is a rear view showing a cathode side of a first focusing electrode.

FIG. 13 is a rear view showing the cathodes 1*a*, 1*b* and 1*c* side of the first focusing electrode 6. The first focusing electrode 6 has a box-like form, and on the surface of the cathodes 1*a*, 1*b*, 1*c* side of the first focusing electrodes 6, circular apertures 6*a*, 6*b* and 6*c* located at positions corresponding to the cathodes 1*a*, 1*b* and 1*c* are provided. On the same surface, there are set up paired plates 6*d*, 6*e* and 6*f* which are located at vertically opposite sides of the apertures 6*a*, 6*b* and 6*c*, respectively, and each has a predetermined thickness and are spaced slightly larger than the diameter of the apertures 6*a*, 6*b* and 6*c*.

On the surface of the final accelerating electrode 8 (screen side) of of the first focusing electrode 6, there are formed vertically long square apertures 6*g*, 6*h* and 6*i* each having a width similar to the diameter of the apertures 6*a*, 6*b* and 6*c*.

The second focusing electrode 7 has a box-like form. On the surface of the cathodes 1*a*, 1*b* and 1*c* side of the second focusing electrode 7, there are formed laterally long square apertures 7*a*, 7*b* and 7*c* each having a vertical length slightly larger than the diameter of the apertures 6*a*, 6*b* and 6*c*.

According to the electron gun thus constructed, the electron beams emitted from the cathodes 1*a*, 1*b* and 1*c* are accelerated and converged by the respective electrodes described above and are projected toward the fluorescent layer. The focusing operation of each electrode will be described below.

Figure 14:
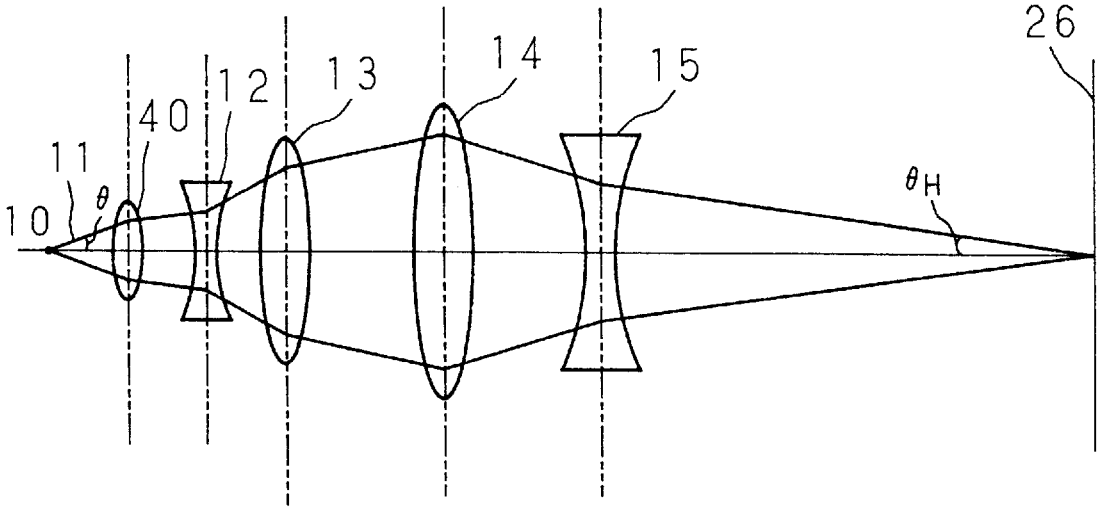
FIG. 14 shows a horizontal sectional view and an operation of electron lenses in the case where electron beams are deflected toward a periphery of a screen.
Figure 15:
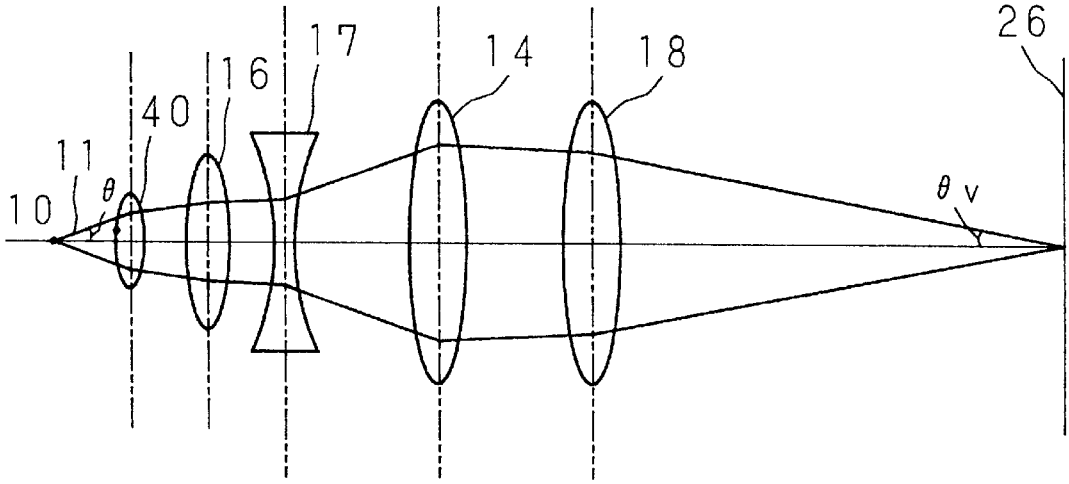
FIG. 15 shows a vertical sectional view and an operation of electron lenses in the case where electron beams are deflected toward a periphery of a screen.

FIGS. 14 and 15 each shows a section of the electron beams and an operation of the electron lenses in the case where the electron beams are deflected toward a periphery of the screen. FIG. 14 shows a horizontal section of the electron beams, and FIG. 15 shows a vertical section of the electron beams. In these figures, reference numeral 10 indicates a cross-over position of the electron beams corresponding to the object point, and numeral 11 indicates a path of the electron beams at the most external angle.

Figure 1:
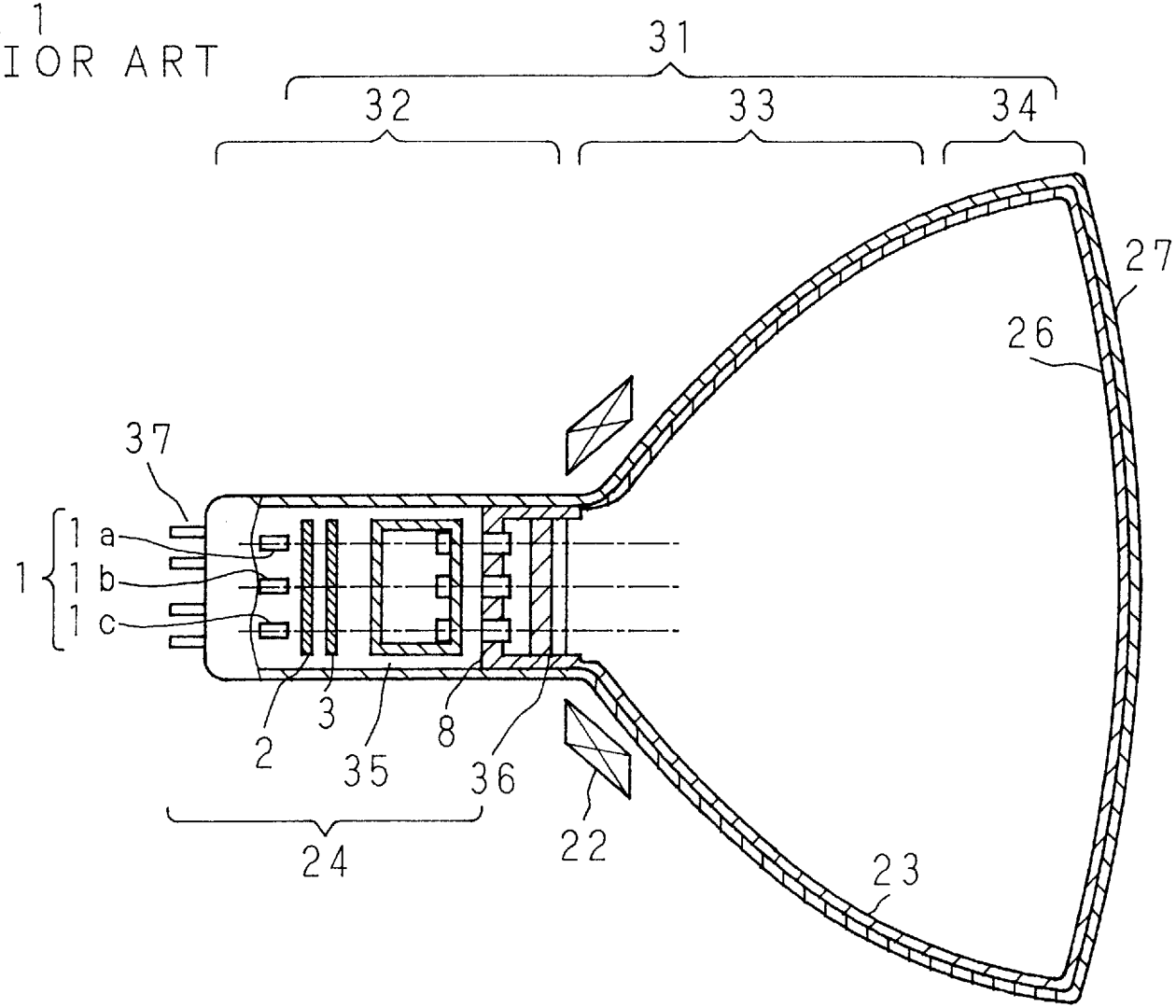
FIG. 1 PRIOR ART
FIG. 1 is a schematic cross sectional view showing a conventional cathode-ray tube provided with an electron gun.
Figure 2:
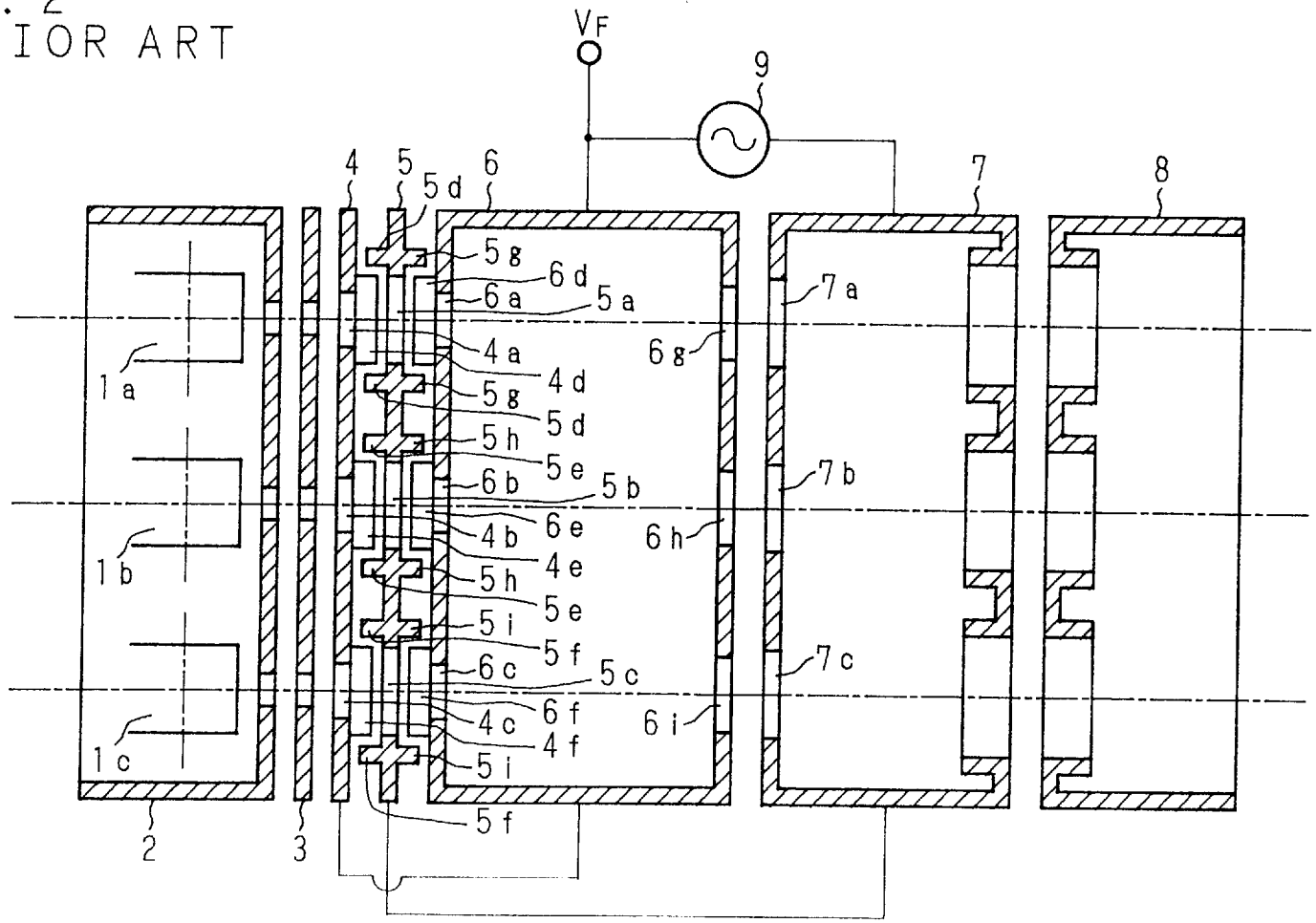
FIG. 2 PRIOR ART
FIG. 2 is an enlarged cross sectional view showing a conventional electron gun.
Figure 3:
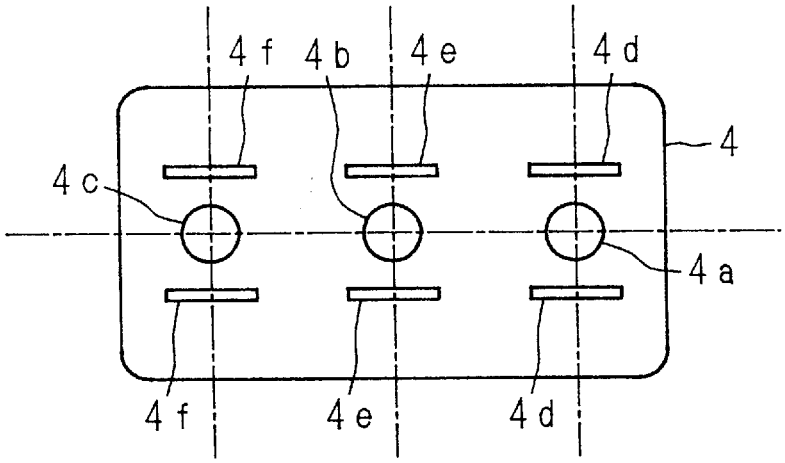
FIG. 3 PRIOR ART
FIG. 3 is a front view of a first auxiliary electrode.
Figure 4:
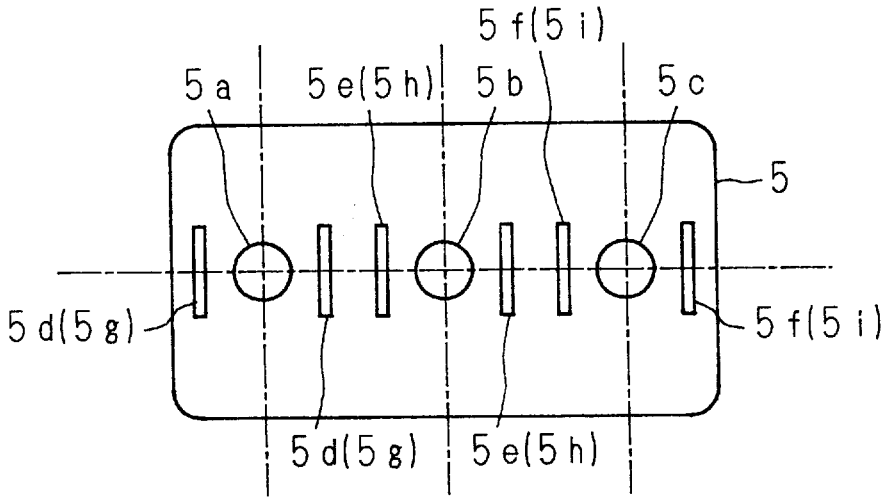
FIG. 4 PRIOR ART
FIG. 4 is a rear view of a second auxiliary electrode.
Figure 5:
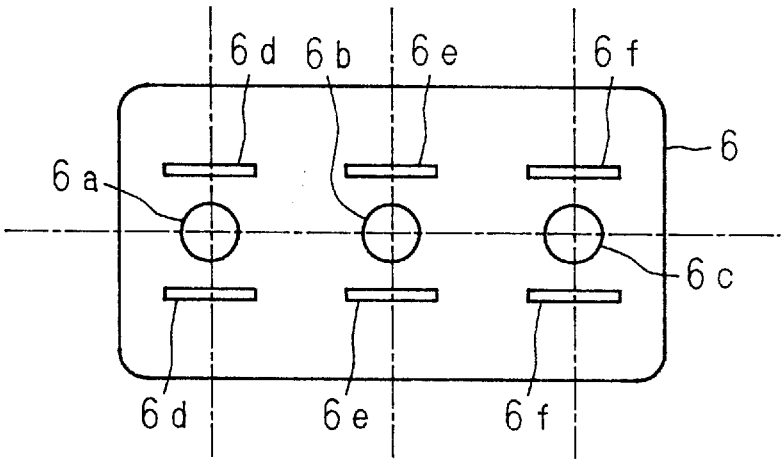
FIG. 5 PRIOR ART
FIG. 5 is a rear view of a first focusing electrode viewed from a cathode side.
Figure 6:
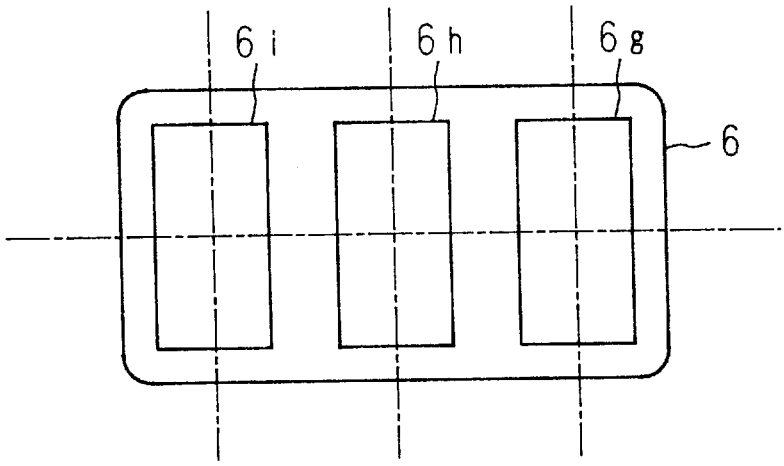
FIG. 6 PRIOR ART
FIG. 6 is a front view of a first focusing electrode viewed from a screen side.
Figure 7:
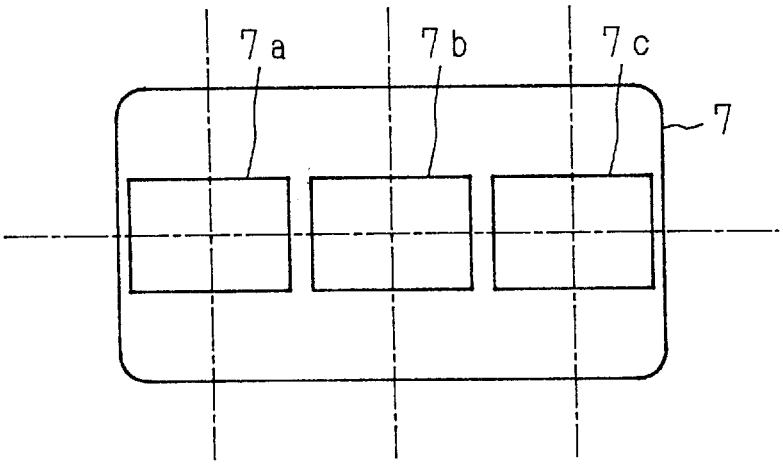
FIG. 7 PRIOR ART
FIG. 7 is a rear view o a second focusing electrode viewed from a cathode side.
Figure 8:
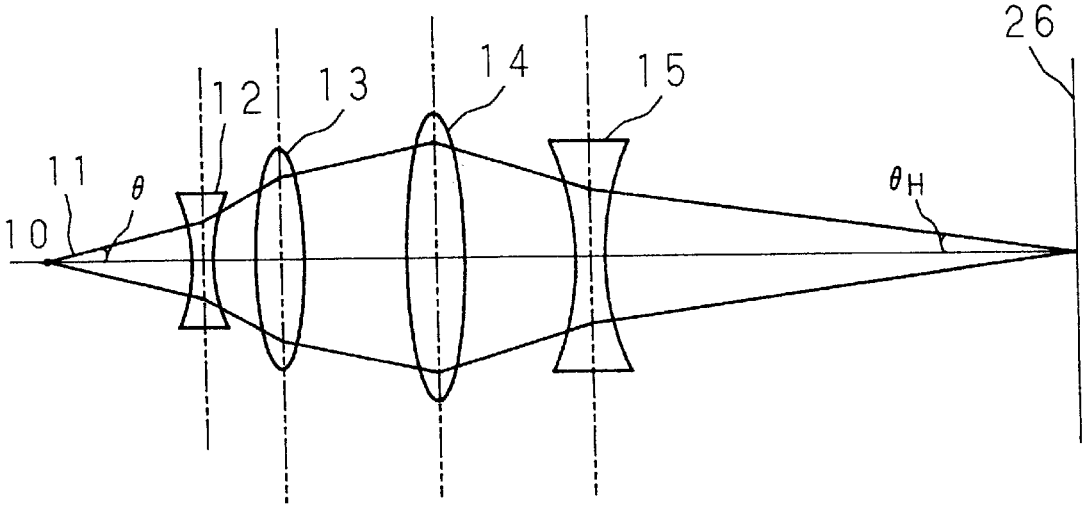
FIG. 8 PRIOR ART
FIG. 8 shows a horizontal sectional view and an operation of electron lenses in the case where electron beams are deflected toward a periphery of a screen.
Figure 9:
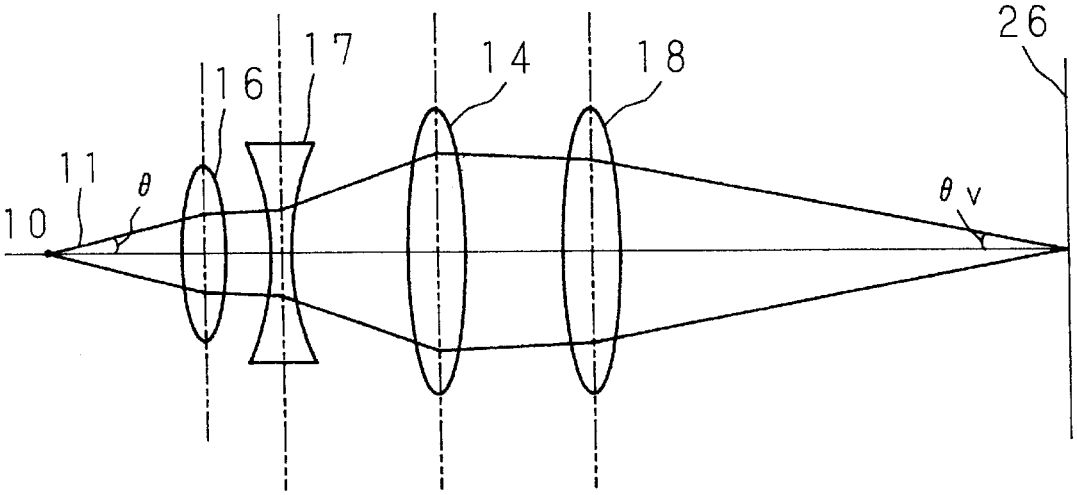
FIG. 9 PRIOR ART
FIG. 9 shows a vertical sectional view and an operation of electron lenses in the case where electron beams are deflected toward a periphery of a screen.

A description will now be given in connection with the horizontal direction. The electron beams diverging at the diverging angle θ from the object point 10 impinge at an incident angle $\theta_H$ on the screen 26 after passing through a convex lens 40 which is a horizontal operation of an subsidiary lens formed of the first subsidiary lens electrode 20, second subsidiary lens electrode 21 and third focusing electrode 30, a concave lens 12 which is a horizontal operation of a first quadrupole lens formed of the third focusing electrode 30 and first focusing electrode 6, a convex lens 13 which is a horizontal operation of a second quadrupole lens formed of the first and second focusing electrodes 6 and 7, a convex lens 14, which is a main electron lens formed of the second focusing electrode 7 and final accelerating electrode 8, and a concave lens 15 which is formed by a horizontal component of a magnetic field of the deflection yoke 22 (see FIG. 1).

A description will now be given in connection with the vertical direction. The electron beams diverging at the diverging angle θ from the object point 10 impinge at an incident angle $\theta_V$ on the screen 26 after passing through the convex lens 40 which is a vertical operation of a subsidiary lens formed of the first subsidiary lens electrode 20, second subsidiary lens electrode 21 and third focusing electrode 30, a convex lens 16 which is a vertical operation of a first quadrupole lens formed of the third focusing electrode 30 and the first focusing electrode 6, the concave lens 17 which is a vertical operation of the second quadrupole lens formed of the first and second focusing electrodes 6 and 7, the convex lens 14 which is a main electron lens formed of the second focusing electrode 7 and final accelerating electrode 8, and a convex lens 18 which is formed by a vertical component of the magnetic field of the deflection yoke 22 (see FIG. 1).

Although the operation of the quadrupole lenses according to the present invention is slightly weaker than that of the conventional quadrupole lenses, this disadvantage can be overcome by increasing the lengths of the plates 6*d*, 6*e*, 6*f*, 30*d*, 30*e* and 30*f* in the advancing direction of the electron beams.

In contrast to the conventional electron gun including four electrodes, i.e., two focusing electrodes and two auxiliary electrodes, the electron gun according to the invention has a simple structure including three electrodes, i.e., three focusing electrodes, by which the diameter of the electron beam spot at the periphery of the screen can be reduced and the roundness thereof can be improved. Thereby, a high resolution can be obtained throughout the screen.

The distinctive feature of the invention is that it can simplify the structure of the electron gun employing the multi-stage focusing electrodes. In the structure shown in FIG. 11, when the electron gun is of a bipotential type not provided with the first and second subsidiary lenses 20 and 21, the third focusing electrode 30 is opposed to the accelerating electrode 3. An electric field generated near the accelerating electrode 3 is very near to the cross-over position of the electron beams, so that the spot characteristics of the electron beams is significantly affected. Accordingly, superposition of the voltage synchronized with the deflection voltage on the third focusing electrode 30 directly affects the electric field near the accelerating electrode 3, resulting in a significant influence on the spot characteristics of the electron beams. In this case, a high resolution can not be obtained.

Meanwhile, in the embodiment shown in FIG. 11, the electric field generated between the second subsidiary lens 21 and the third focusing electrode 30 does not vary significantly even when the voltage synchronized with the deflection current superposed on a constant focus voltage is applied on the third focusing electrode 30, because the apertures 30*a*, 30*b* and 30*c* at the third focusing electrode 30 and the apertures at the second subsidiary lens 21 are sufficiently large. Further, the third focusing electrode 30 is sufficiently remote from the cross-over position of the electron beams, so that it hardly affects the spot characteristics of the electron beams. Therefore, the invention can be employed in the multi-stage focusing electrodes. The operation of the convex lens 40 is added as compared with the prior art, and the convex lens 40 functions to reduce the spherical aberration of the main electron lens 14 at the high luminance region. Therefore, deterioration of focus at the high luminance region can be prevented.

Embodiment 2

Figure 16:
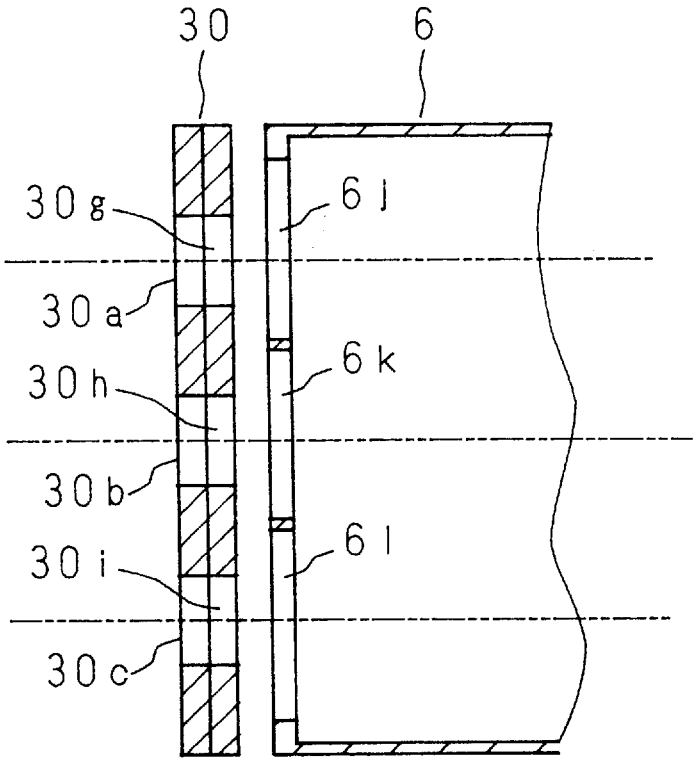
FIG. 16 shows an electrode of an electron gun of another embodiment of the present invention.
Figure 17:
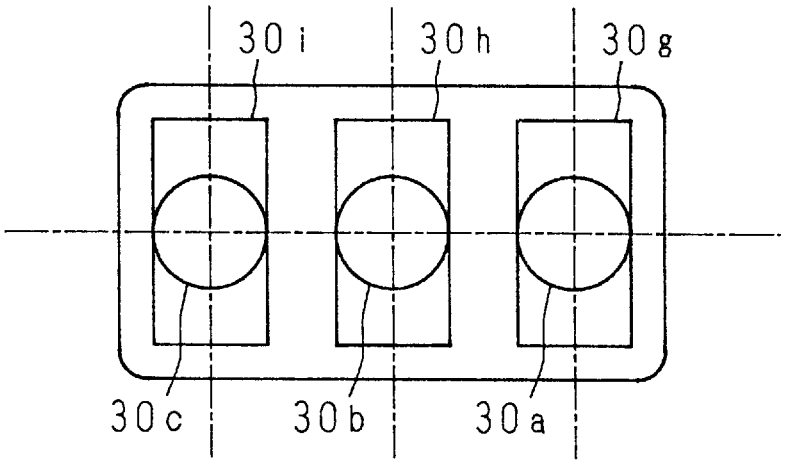
FIG. 17 shows an electrode of an electron gun of another embodiment of the present invention.
Figure 18:
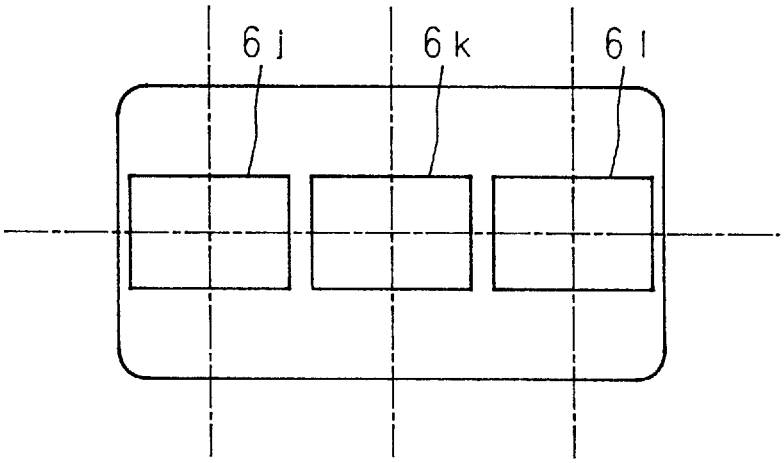
FIG. 18 shows an electrode of an electron gun of another embodiment of the present invention.

FIGS. 16, 17 and 18 show electrodes of an electron gun of another embodiment according to the present invention. FIG. 16 is a cross sectional view showing major portions of the third focusing electrode 30 and the first focusing electrode 6. FIG. 17 is a front view of the third focusing electrode 30. FIG. 18 is a rear view of the first focusing electrode 6. In this embodiment, the third focusing electrode 30 and the first focusing electrode 6 shown in FIGS. 12 and 13 are replaced with the third focusing electrode 30 and the first focusing electrode 6 having the following structures. The plate-like third focusing electrode 30 is provided at its half portion locating on the cathodes 1*a*, 1*b* and 1*c* side in the direction of its thickness, with circular apertures 30*a*, 30*b* and 30*c* in the same way as those of the aforementioned embodiment, and is provided at the other half portion with vertically long square apertures 30*g*, 30*h* and 30*i* each having a width similar to the diameter of the apertures 30*a*, 30*b* and 30*c*. On the surface of the cathodes 1*a*, 1*b* and 1*c* side of the first focusing electrode 6 is provided with square apertures 6*j*, 6*k* and 6*l* laterally long and each having a vertical length similar to the diameter of the apertures 30*a*, 30*b* and 30*c*.

By setting the sizes of these apertures 30*a*, 30*b*, 30*c*, 6*j*, 6*k* and 6*l* to appropriate values, a similar effect can be achieved to embodiment 1. Embodiment 2 has a further simplified structure.

In the cathode-ray tube and the electron gun according to the present invention, as described above, the electron gun of the multi-stage convergence type includes a plurality of focusing electrodes, the quadrupole lens nearest to the cathode has a diverging function in the horizontal scanning direction and a converging function in the vertical scanning direction, and the quadrupole lens in the next stage has a converging function in the horizontal scanning direction and a diverging function in the vertical scanning direction. In this structure, when the voltage synchronized with the deflection current superposed on a constant focus voltage is applied on the focusing electrode, the operation of the quadrupole lenses is not influenced significantly. Accordingly, it is possible to reduce the diameter of the electron beam spot at the periphery of the screen and improve the roundness thereof with a structure simpler than the prior art.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electron gun having a multi-stage structure, comprising:

at least one cathode;

a control electrode;

an accelerating electrode;

a first subsidiary lens electrode;

a second subsidiary lens electrode;

a third focusing electrode for forming a front-stage lens with said first subsidiary lens electrode and said second subsidiary lens electrode;

a first focusing electrode for forming a first quadrupole lens with said third focusing electrode wherein the first quadrupole lens has a convex lens function in one direction of a horizontal and vertical direction, and a concave lens function in the other direction of the horizontal and vertical direction;

a second focusing electrode for forming a second quadrupole lens with said first focusing electrode wherein the second quadrupole lens has a convex lens function in one direction of the horizontal and vertical direction, and a concave lens function in the other direction of the horizontal and vertical direction;

a final accelerating electrode for forming a main lens with said second focusing electrode;

said electrodes being arranged in this order from said at least one cathode, and each electrode having electron-beam passage holes, means for electrically connecting said accelerating electrode and said second subsidiary lens electrode;

means for electrically connecting said first subsidiary lens electrode and said first focusing electrode and applying a predetermined focusing voltage thereto; and means for electrically connecting said third focusing electrode and said second focusing electrode and applying a voltage thereto, obtained by superimposing a voltage on the predetermined focusing voltage, the voltage increasing in synchronism with a deflection current, wherein said third focusing electrode is flat, having a side facing said first focusing electrode on which a pair of parallel plates are arranged on opposite sides of a horizontal scanning direction of the electron-beam passage hole at an interval larger than a diameter of each of the electron-beam passage holes, and said first focusing electrode is box-shaped, having a side facing said third focusing electrode on which a pair parallel plates are arranged on opposite sides of the vertical scanning direction of the electron-beam passage at an interval larger than the diameter of each of the electron-beam passage holes.

2. An electron gun having a multi-stage structure, comprising:

at least one cathode;

a control electrode;

an accelerating electrode;

a first subsidiary lens electrode;

a second subsidiary lens electrode;

a third focusing electrode for forming a front-stage lens with said first subsidiary lens electrode and said second subsidiary lens electrode;

a first focusing electrode for forming a first quadrupole lens with said third focusing electrode wherein the first quadrupole lens has a convex lens function in one direction of a horizontal and vertical direction, and a concave lens function in the other direction of the horizontal and vertical direction;

a second focusing electrode for forming a second quadrupole lens with said first focusing electrode wherein the second quadrupole lens has a convex lens function in one direction of the horizontal and vertical direction, and a concave lens function in the other direction of the horizontal and vertical direction;

a final accelerating electrode for forming a main lens with said second focusing electrode;

said electrodes being arranged in this order from said at least one cathode, and each electrode having electron-beam passage holes, means for electrically connecting said accelerating electrode and said second subsidiary lens electrode;

means for electrically connecting said first subsidiary lens electrode and said first focusing electrode and applying a predetermined focusing voltage thereto; and means for electrically connecting said third focusing electrode and said second focusing electrode and applying a voltage thereto, obtained by superimposing a voltage on the predetermined focusing voltage, the voltage increasing in synchronism with a deflection current, wherein said third focusing electrode is flat, having a side facing said first focusing electrode in which a rectangular aperture is provided around the electron-beam passage hole, the rectangular aperture having a horizontal scanning direction length equal to a diameter of each of the electron-beam passage holes and a vertical scanning direction length larger than the diameter of each of the electron-beam passage holes, and said first focusing electrode is box-shaped, having a side facing said third focusing electrode in which a rectangular aperture is provided for allowing passage of an electron-beam, the rectangular aperture having a horizontal scanning direction length larger than a diameter of each of the electron-beam passage holes of said third focusing electrode and a vertical scanning direction length equal to the diameter of each of the electron-beam passage holes of said third focusing electrode.

* * * * *